US010823531B2

(12) United States Patent
Bellah et al.

(10) Patent No.: US 10,823,531 B2
(45) Date of Patent: Nov. 3, 2020

(54) RETICLE DISC WITH FIBER ILLUMINATED AIMING DOT

(71) Applicant: Lightforce USA, Inc., Orofino, ID (US)

(72) Inventors: Brian J. Bellah, Orofino, ID (US); Grant M. W. Minor, Moscow, ID (US)

(73) Assignee: Lightforce USA, Inc., Orofino, ID (US)

( * ) Notice: Subject to any disclaimer, the term of this patent is extended or adjusted under 35 U.S.C. 154(b) by 396 days.

(21) Appl. No.: 15/843,123

(22) Filed: Dec. 15, 2017

(65) Prior Publication Data

US 2018/0224242 A1 Aug. 9, 2018

Related U.S. Application Data

(60) Provisional application No. 62/463,958, filed on Feb. 27, 2017, provisional application No. 62/456,905, filed on Feb. 9, 2017.

(51) Int. Cl.
*F41G 1/30* (2006.01)
*F41G 1/34* (2006.01)
*F41G 1/38* (2006.01)

(52) U.S. Cl.
CPC ..... *F41G 1/345* (2013.01); *F41G 1/38* (2013.01)

(58) Field of Classification Search
CPC ..... F41G 1/38; F41G 1/14; F41G 1/30
USPC ..... 42/111, 119, 122, 123, 130, 132
See application file for complete search history.

(56) References Cited

U.S. PATENT DOCUMENTS 1,931,552 A * 10/1933 Maris ..... G02B 23/10 42/123
1,943,387 A * 1/1934 Jung ..... F41G 1/30 356/255
2,171,571 A * 9/1939 Karnes ..... G02B 27/34 42/123
3,540,256 A 11/1970 Thompson
4,201,618 A * 5/1980 Lewis ..... G02B 6/255 156/158
4,417,814 A 11/1983 Doliber
(Continued)

OTHER PUBLICATIONS

European Patent Office, International Search Report & Written Opinion issued in related international application No. PCT/US2018/17030, dated Aug. 13, 2018, 9pp.

*Primary Examiner* — Derrick R Morgan
(74) *Attorney, Agent, or Firm* — Wood Herron & Evans LLP

(57) ABSTRACT

Provided is an illuminated dot reticle for use in a rifle scope having an optical path defined through axially spaced-apart objective and ocular lenses and method manufacturing a reticle disc assembly. A reticle disc has a first surface facing the objective lens and a second surface facing the ocular lens. A first reticle pattern, including a central aiming point, is applied to one of the reticle disc surfaces. An optical fiber has a proximal end portion and a distal end, with a light source configured to deliver light to the proximal end portion of the optical fiber. The optical fiber is secured to one of the reticle plate surfaces such that the distal end is positioned to transmit light from the light source toward the ocular lens in the optical path, providing an illuminated dot at the central aiming point.

23 Claims, 10 Drawing Sheets

(56) References Cited

U.S. PATENT DOCUMENTS 4,627,171 A * 12/1986 Dudney ..... F41G 1/345 42/123
5,065,520 A * 11/1991 Shimizu ..... F41G 1/38 33/297
5,157,839 A * 10/1992 Beutler ..... F41G 1/467 33/265
5,230,033 A * 7/1993 Soodak ..... G02B 6/4402 174/108
5,283,427 A * 2/1994 Phillips ..... G02B 23/12 250/214 VT
5,414,557 A * 5/1995 Phillips ..... G02B 23/12 250/214 VT
5,924,234 A * 7/1999 Bindon ..... G02B 27/34 33/298
6,081,373 A * 6/2000 Bryant ..... G02B 23/10 359/387
6,311,405 B1 * 11/2001 Slates ..... F41G 1/467 124/87
6,802,131 B1 * 10/2004 Scholz ..... G01C 15/06 33/265
6,981,329 B1 1/2006 Strathman
7,428,796 B1 * 9/2008 Stenton ..... F41G 1/345 42/123
7,471,452 B2 12/2008 Schreiter et al.
7,627,976 B1 12/2009 Olson
7,676,137 B2 * 3/2010 Schick ..... F41G 1/345 385/147
7,821,708 B2 * 10/2010 Robitaille ..... F41G 1/345 359/399
8,091,268 B2 1/2012 York
8,254,746 B2 8/2012 Schick et al.
8,705,173 B2 4/2014 Peters et al.
8,925,238 B2 1/2015 Anderson
9,222,753 B2 * 12/2015 Hornung ..... F41G 1/345
9,482,488 B2 * 11/2016 Moyle ..... F41G 1/345
2003/0086165 A1 * 5/2003 Cross ..... F41G 1/38 359/424
2004/0020099 A1 * 2/2004 Osborn, II ..... F41G 1/38 42/122
2006/0288627 A1 * 12/2006 Liang ..... F41G 1/38 42/123
2007/0206171 A1 * 9/2007 Fiolka ..... G03F 7/70108 355/67
2007/0223087 A1 * 9/2007 Pochapsky ..... G02B 23/12 359/359
2008/0192245 A1 * 8/2008 Stenton ..... F41G 1/345 356/251
2009/0100735 A1 * 4/2009 Schick ..... F41G 1/345 42/123
2010/0110407 A1 * 5/2010 Kobayashi ..... G03F 7/70091 355/71
2011/0280040 A1 11/2011 Schick et al.
2012/0144720 A1 * 6/2012 Lacorte ..... F41G 1/38 42/130
2013/0170027 A1 7/2013 Peters et al.
2013/0251317 A1 * 9/2013 Faulkner ..... G02B 6/255 385/96
2014/0007486 A1 * 1/2014 Hornung ..... F41G 1/345 42/123
2014/0041277 A1 * 2/2014 Hamilton ..... F41G 1/36 42/122
2014/0130395 A1 * 5/2014 Scroggins ..... F41G 1/467 42/122
2014/0220839 A1 * 8/2014 Pribanic ..... B32B 5/24 442/1
2014/0286615 A1 * 9/2014 Faulkner ..... G02B 6/4495 385/96
2015/0198416 A1 * 7/2015 Moyle ..... G02B 23/00 359/428
2015/0276346 A1 * 10/2015 Hamilton ..... F41G 1/345 42/123
2015/0364415 A1 * 12/2015 Zhao ..... H01L 21/0274 257/774
2016/0169619 A1 6/2016 Stockdill
2016/0238343 A1 * 8/2016 Jakob ..... G02B 23/105
2017/0102553 A1 * 4/2017 Plumb ..... G02B 27/32
2017/0123225 A1 * 5/2017 Wieneke ..... F41G 1/38
2018/0224649 A1 * 8/2018 Bellah ..... F21V 14/08
2018/0338767 A1 * 11/2018 Dasnurkar ..... A61B 17/12186
2018/0340753 A1 * 11/2018 Griffin ..... G02B 27/34
2019/0195598 A1 * 6/2019 Hamilton ..... F41G 1/473
2019/0376766 A1 * 12/2019 Fruechtel ..... F41G 1/44

* cited by examiner

RETICLE DISC WITH FIBER ILLUMINATED AIMING DOT

This application claims priority to U.S. Provisional Patent Application Nos. 62/456,905, filed Feb. 9, 2017, and 62/463,958, filed Feb. 27, 2017, and incorporates the same herein by reference.

TECHNICAL FIELD

This invention relates to providing an illuminated aiming dot, including in combination with a glass reticle disc or plate, in an optical sighting device, such as a riflescope. More particularly, it provides a reticle that can be illuminated in a traditional way, for low ambient light situations and extended range aiming, along with a separately illuminated aiming dot provided by an optical fiber attached to or integrated with the reticle plate, for high ambient light and close quarters situations.

BACKGROUND

A standard glass substrate reticle used in a rifle scope can be illuminated with a light emitting diode (LED) or other light source, providing the user a higher contrast between reticle design and target in low ambient light conditions. The reticle design is etched, engraved, or otherwise applied to a surface of the glass plate and illumination is provided through the glass from its periphery or is projected onto the glass plate surface. This type of reticle can be very detailed and complex, but this form of illumination may not provide adequate intensity for good contrast during bright ambient light conditions, as the emitted light simply fans out, or floods, the reticle structure.

A smaller, more condensed point emission from an LED or similar light source can achieve the required intensity levels to provide high contrast in high light conditions, becoming daylight visible. Using fiber optic light guides, the emitted light from the LED or other light source can be directed to a desired location on a reticle structure, providing a singular illuminated point of light. Systems utilizing these fiber optic light guides currently either secure the optical fiber to a metallic wire, which does not make available to the shooter other reticle features, such as extended holdover markings and "floating" wind dots, or use a self-supporting fiber post to provide the illuminated aiming dot independent of the reticle and in a different focal plane from the reticle. It was commonly believed that this design can only be used in the second focal plane because the first focal plane would require the reticle to be much smaller to appear the correct size to the user and it is difficult to use optic fibers that small, or at least to make the center dot that small.

Glass substrate reticle discs can be engraved or etched, allowing for much more elaborate features than metallic wire crosshairs, and are typically used to provide the shooter a great many options regarding moving targets, variations in wind speeds, ranging marks for various distances, etc. As described in U.S. Pat. No. 5,924,234, issued Jul. 20, 1999, and U.S. Patent Application Publication No. 2015/0276346, published Oct. 1, 2015, using an optical fiber with glass reticle technology for the first focal plane was believed to be unworkable without making the fiber cable visible to the observer, which could obstruct the view and could be distracting.

Another approach proposed to put an illuminated dot at the center of a "complex" reticle (not just a crosshair, but one with many subtension lines and/or floating features) by using an etched or engraved glass reticle in the first focal plane, that does not include the major vertical and horizontal stadia lines, and a wire reticle in the second focal plane that hides the center dot illumination fiber. Optically overlaid, the two separate reticles can create the appearance of a complex first focal plane reticle with an illuminated center dot. Wire reticles can be delicate structures that can be difficult to manufacture and less robust than a glass disc reticle. Prior attempts recognized that it can be difficult to maintain the two reticles in separate focal planes in alignment with each other.

SUMMARY OF THE INVENTION

Provided is an illuminated dot reticle for use in a rifle scope having an optical path defined through axially spaced-apart objective and ocular. A reticle disc has a first surface facing the objective lens and a second surface facing the ocular lens. A first reticle pattern, including a central aiming point, is applied to one of the reticle disc surfaces. An optical fiber has a proximal end portion and a distal end, with a light source configured to deliver light to the proximal end portion of the optical fiber. The optical fiber is secured to one of the reticle plate surfaces such that the distal end is positioned to transmit light from the light source toward the ocular lens in the optical path, providing an illuminated dot at the central aiming point.

The present invention combines a glass substrate reticle, with more detailed reticle features for the shooter, and a fiber light guide to deliver a high intensity central aiming point, what the prior art teaches to be unworkable, by attaching an optical fiber directly to the surface of a complex etched reticle for the first focal plane. If desired, the fiber can be aligned with a major stadia line as a feature of reticle pattern on a glass plate. This construction provides a superior solution for the shooter requiring high contrast daylight visibility and long range, high wind, shooting situations. This combination provides daylight visibility of a central aiming dot, while still allowing for conventional illumination to flood light other reticle features, if desired. This can provide multiple illumination options for the user.

The present invention can be used in the first or second focal plane, but a benefit is that, in first focal plane, a detailed reticle pattern (which also can be illuminated) allows for precision aiming at longer distances and higher magnification power, while at low or no magnification an illuminated central aiming dot can be made bright enough to be seen, even in bright ambient light conditions, for close quarters engagement.

According to another aspect of the invention providing a method of assembly, an optical fiber can be directly adhered to the surface of a glass reticle plate using capillary action to draw a minimal amount of liquid, UV-cure adhesive along the contact between the fiber and plate surface from a peripheral delivery point and then exposing it to UV light to cure the adhesive.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING FIGURES

The figures are not drawn to scale and certain features, structures, and/or dimensions are enlarged or exaggerated relative to other features or structures for clarity of illustration. Like reference numerals are used to indicate like parts throughout the various drawing figures, wherein.

DETAILED DESCRIPTION

Figure 1:
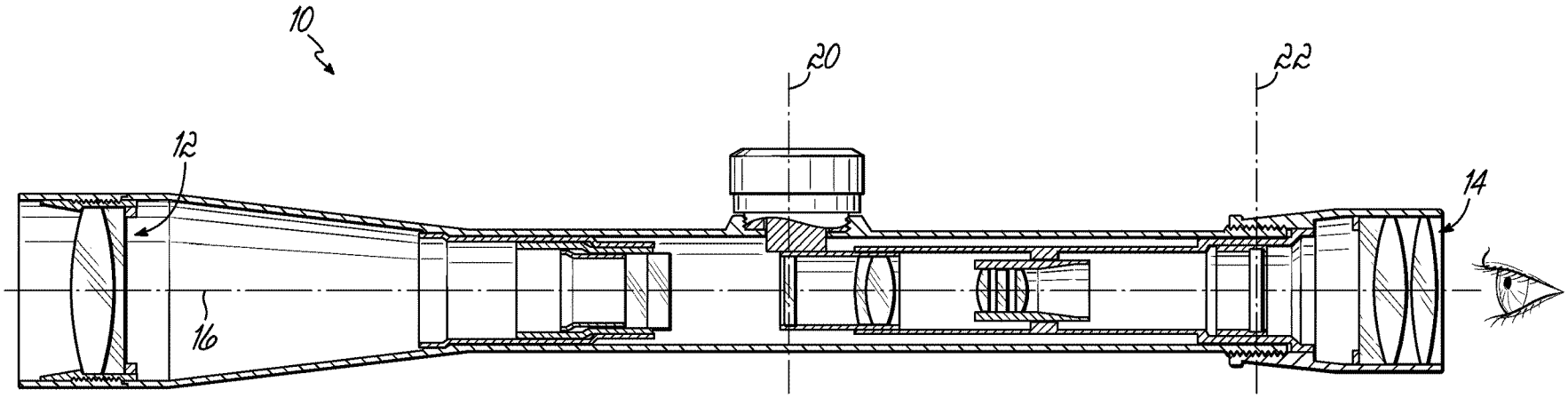
FIG. 1 is a schematic side sectional view of a rifle scope showing an optical path through objective and ocular lens assemblies.
Figure 3:
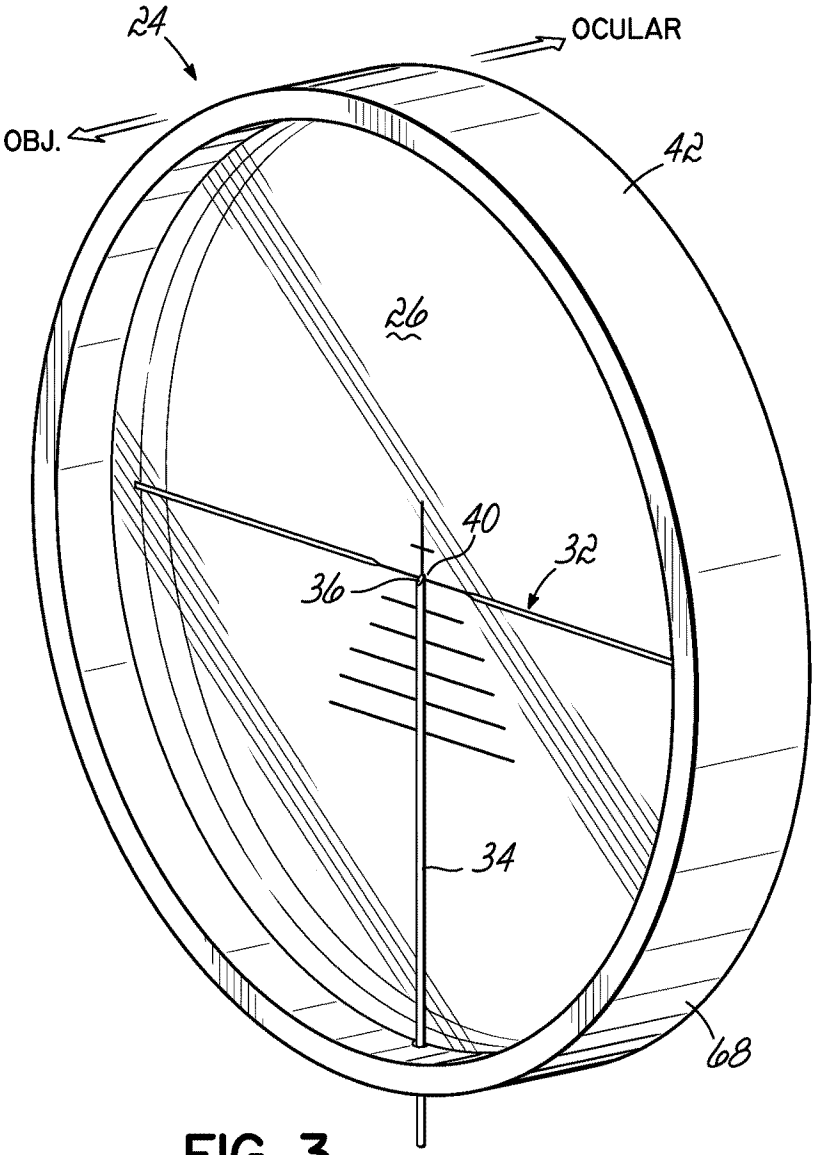
FIG. 3 is an assembled isometric view thereof in a mounting housing or ring.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIG. 1, a rifle scope 10 is shown schematically, illustrating the general location of an objective lens assembly 12, an ocular lens assembly 14, and an optical path 16 axially defined through them. Within the scope body is an erector tube assembly 18, the construction and operation of which is well-known in the field. A first or front focal plane 20 may be defined at the forward or objective end of the erector assembly 18 and a second or rear focal plane 22 may be defined at its rear or ocular end. As is also well-known in the field, an aiming reticle can be positioned at either (or both) of the first and second focal planes 20, 22. Magnification of the optical image viewed through the scope 10, whether adjustable or fixed, is done by lenses positioned between the first and second focal planes 20, 22.

Referring now to FIGS. 2-5, in a first embodiment, a reticle disc assembly 24 is provided for an optical weapon sighting device, such as a riflescope 10. The assembly 24 includes a disc 26, typically made of high quality glass providing clarity and a high level of light transmission. The disc 26 has two substantially flat faces, an objective face 28 and an ocular face 30. When installed in a rifle scope, the objective face 28 is oriented forwardly toward the objective lens 12 and the ocular face 30 is oriented toward the ocular lens 14 and users eye (illustrated schematically in FIG. 1). A reticle pattern 32 may be applied to the disc 26, typically on the objective face 28, by etching, engraving, chromium deposit, or any other well-known means. The reticle pattern 32 may be a simple crosshair pattern, a highly detailed and complex pattern or grid providing ranging and bullet drop compensation markings, or may be any number of variants of intermediate complexity. The reticle pattern 32 on the objective face of 28 of the disc 26 provides a physical reticle that may be illuminated, if desired, by any of several well-known means.

Figure 2:
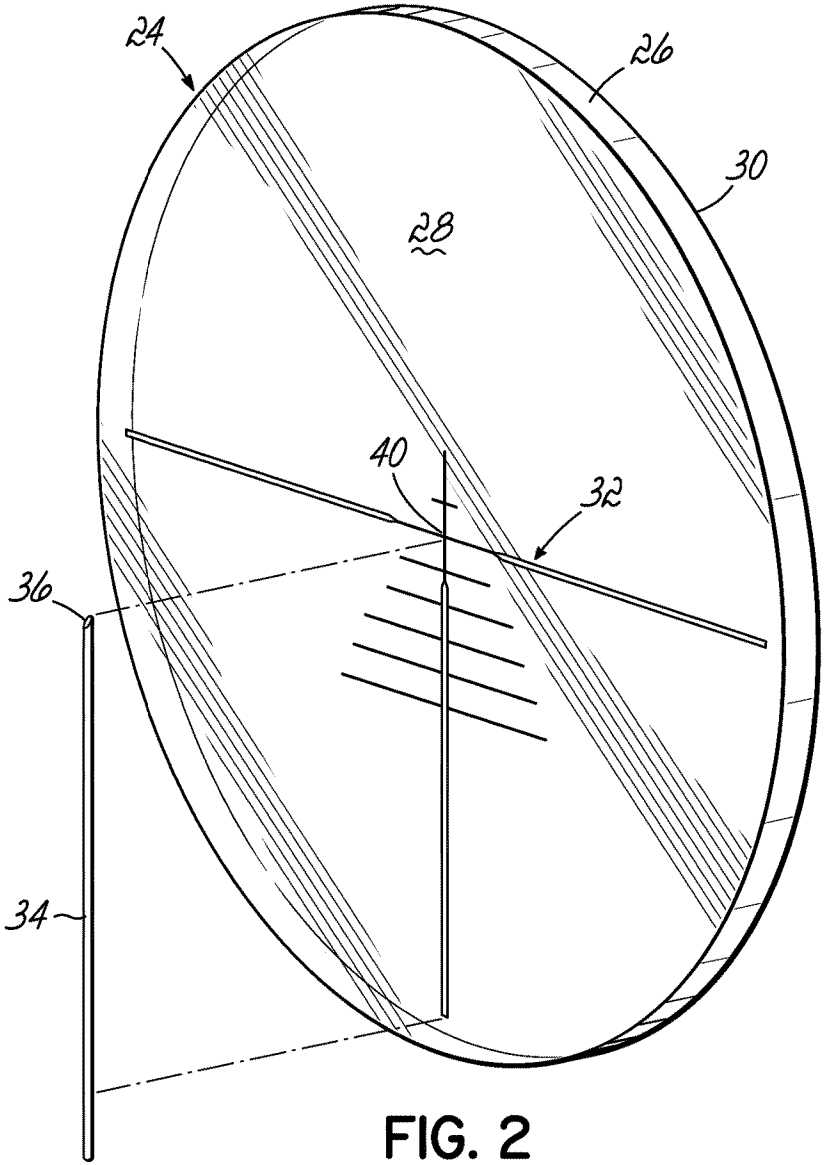
FIG. 2 is an exploded, isometric view of a reticle disc and optical fiber before assembly according to a first embodiment of the invention.

According to one embodiment of the invention, an optical fiber 34 that acts as a light transmitting pipe may be secured, such as with an optical adhesive, directly to the objective face 28 of the reticle disc 26. The optical fiber 34 can be, for example, a 125 micron (μm) multimode optical fiber (50/125 or 62.5/125) with a light-trapping, total internal reflection (TIR) cladding. It does not need to be stiff enough to support itself, as is the case with prior freestanding optical "posts," since it is supported by adhesion to the reticle disc 26 along its exposed length. As will be described in greater detail later, the distal end 36 may include a terminus 38 that is treated to provide an angular facet or notch such that light transmitted through the fiber 34 is reflected by the angled end surface and exits the distal end 36 at a generally right angle relative to the length of the optical fiber 34, when attached to the disc 26, and substantially parallel to the optical axis or optical path 16 of the scope 10, toward the ocular lens 14. Alternatively, the distal end 36 may be bent or curved (not shown) so as to channel light from a substantially squared end directly toward the ocular lens 14. Accordingly, light is projected toward the user's eye to create an illuminated dot at a preselected location, such as a central aiming point 40 of the reticle pattern 32. This would appear to the user as an extremely bright, daylight visible, illuminated dot that serves as an aiming point. The optical fiber 34 may extend from a peripheral edge of the disc 26 to the central aiming point 40, for example, along a major vertical or horizontal stadia of the reticle pattern 32. In the illustration embodiment, the fiber 34 extends along a bottom portion of a primary, vertical stadia line, although any desired orientation can be used. Positioning the fiber 34 along a primary stadia line minimizes visual interference or distraction, if any, of the fiber 34 in the field of view. It is unnecessary, as previously believed, to support the fiber 34 on or to "hide" it behind or in front of a wire or electroformed foil reticle. As illustrated in FIG. 2, the attached fiber 34 and disc 26 may be supported in a frame 42 for use in, for example, a rifle scope 10. In this embodiment, a cover plate is not required.

Figure 4:
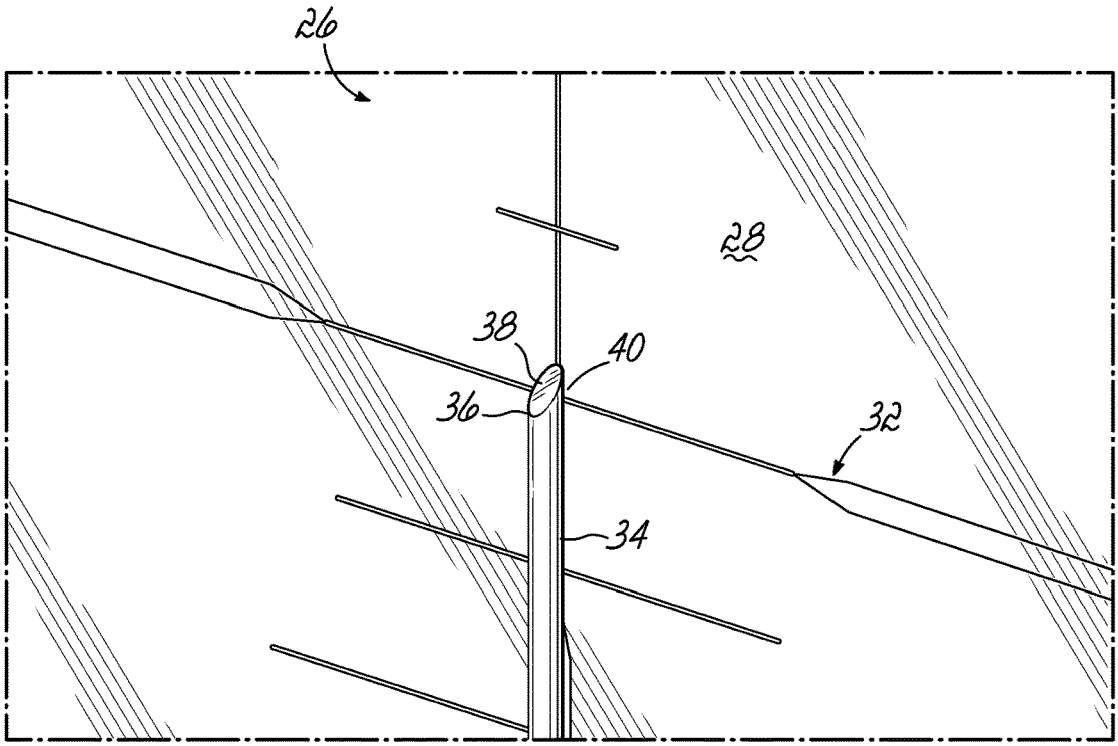
FIG. 4 is an enlarged detail isometric view of the end of the optical fiber from the objective side of the reticle disc.
Figure 5:
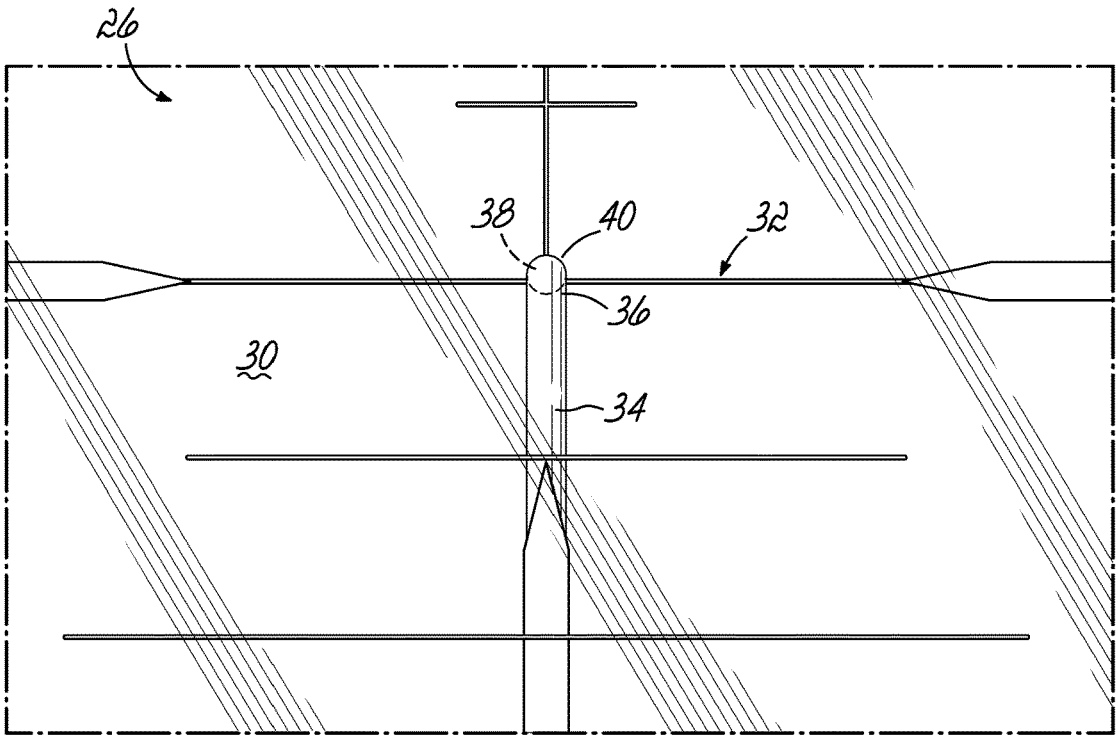
FIG. 5 is an enlarged detail back elevation view from the ocular side of the reticle disc.

The terminus 38 of the optical fiber 34 may be beveled, for example, and polished to provide a reflective surface that redirects light transmitted through the pipe toward the ocular lens 14, as generally described above. A strand of optical fiber, with any protective coating(s) removed, may be clamped in a holding jig with a work portion protruding therefrom. A free end may be ground and polished using successively finer abrasive materials, such as being held at a selected angle against a moving surface holding abrasive sheets. A finished angle in the range of about 44.5° to about 47° has been found to provide a suitable reflector surface to redirect light travelling through the fiber 34 toward the ocular lens 14, although other angles or facet configurations to project a shape other than a round dot can also be used. As shown in FIG. 4, the terminus 38 may be oriented to reflect and project light through the disc 26, providing a brightly illuminated aiming dot at a central aiming point 40 visible to the user looking through the ocular lens 14.

This construction provides a reticle disc assembly 24 with a detailed or complex reticle pattern 32 that may be illuminated by conventional means for use in low-light conditions, if desired, in the first focal plane 20 for making longer-range shots with a magnified optical image. The presence of the optical fiber 34 directly adhered with optical adhesive to the surface 28 of the disc 26 bearing the reticle pattern 32 does not interfere with or significantly occlude the field of view, particularly if it is aligned with a major stadia line of the reticle pattern 32. When adjusted to low or no magnification for taking close quarters shots, the illuminated central aiming point 40 provides a bright aiming dot that is easily visible, even in bright ambient light conditions. Because both the reticle pattern 32 and illuminated center dot are in the same focal plane, there is no concern with improper or changing alignment. This combination provides daylight visibility of a central aiming dot, while still allowing for conventional LED illumination to flood light other reticle features, if desired. This can provide multiple illumination options for the user.

Figure 6:
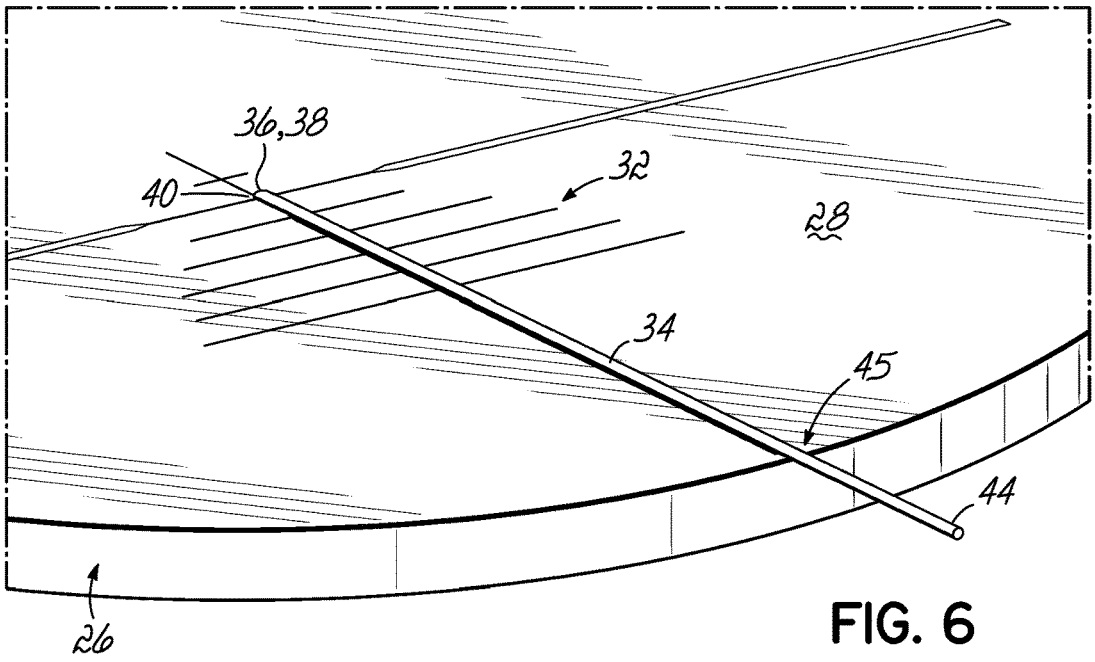
FIG. 6 is an enlarged detail isometric view illustrating the attachment of the optical fiber to the reticle disc according to one embodiment of the invention.

Referring now also to FIG. 6, the invention also includes a method of assembling the optical fiber 34 to a surface 28 of the disc 26. A reticle disc 26 with a reticle pattern applied to its surface (such as by etching, engraving, chromium deposit, etc.) may be positioned substantially horizontally under an assembly microscope. The end-finished portion of the fiber 34, still in a holding jig (not shown), may be placed against the surface 28 of the disc 26 with the terminus 38 correctly positioned at the central aiming point 40 of the reticle pattern 32. The use of the same holding jig for creating the terminus 38 and assembly to the disc 26 can help assure proper finished orientation of the fiber 34 as they are positioned under the assembly microscope. A UV-cure optical adhesive may be applied through a needle-like nozzle (not shown) to the proximal portion of the optical fiber 34, at or adjacent to the periphery of the disc 26 (shown at 45 in FIG. 6). The optical adhesive flows and is drawn by capillary action along the interface between the fiber 34 and disc surface 28, toward the distal end 36. This method of application allows a minimum amount of optical adhesive material to be used, while ensuring that the full length of the portion of the fiber 34 in contact with the disc 26 will be secured. When the adhesive flow reaches or nears the distal end 36 and/or terminus 38, the area is exposed to UV light (such as a high intensity flash) that immediately cures the adhesive and stops any further flow. In limited production, the applicator may be a small gauge hypodermic needle and syringe filled with optical adhesive and may be applied by hand. For larger scale production, the application equipment and/or process may be automated and/or robotized.

Figure 7:
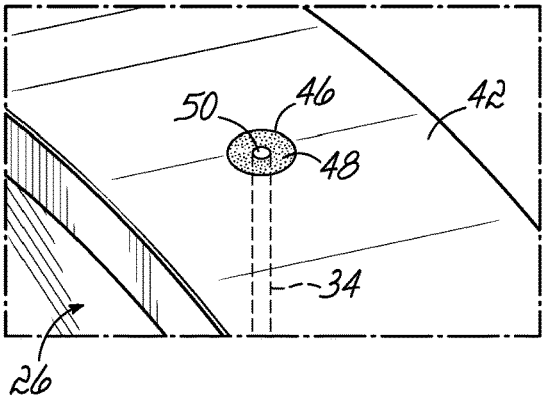
FIG. 7 is an enlarged detail isometric view of a finished end of the optical fiber in the mounting housing or ring according to one embodiment of the invention.
Figure 8:
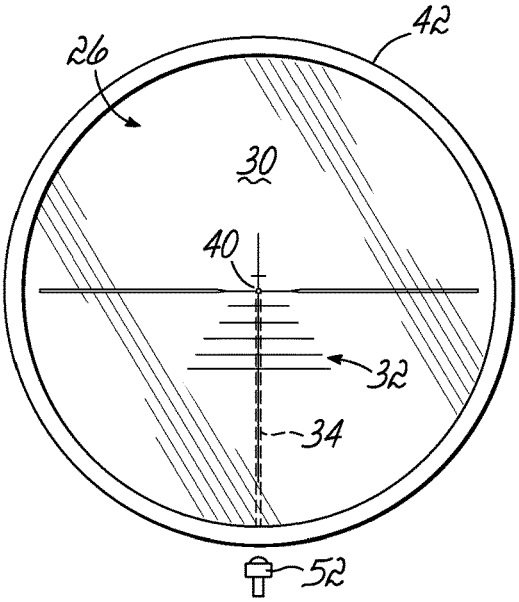
FIG. 8 is a rear elevation view schematically showing placement of an illumination source.
Figure 9:
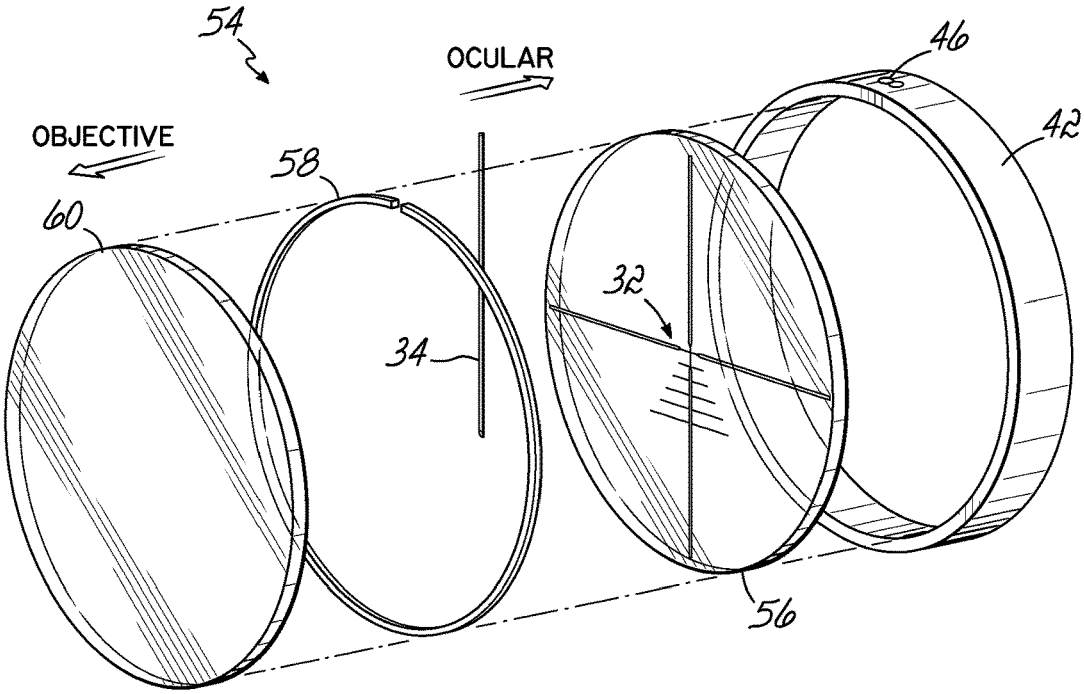
FIG. 9 is an exploded isometric view of a reticle disc and optical fiber before assembly according to a second embodiment of the invention.
Figure 10:
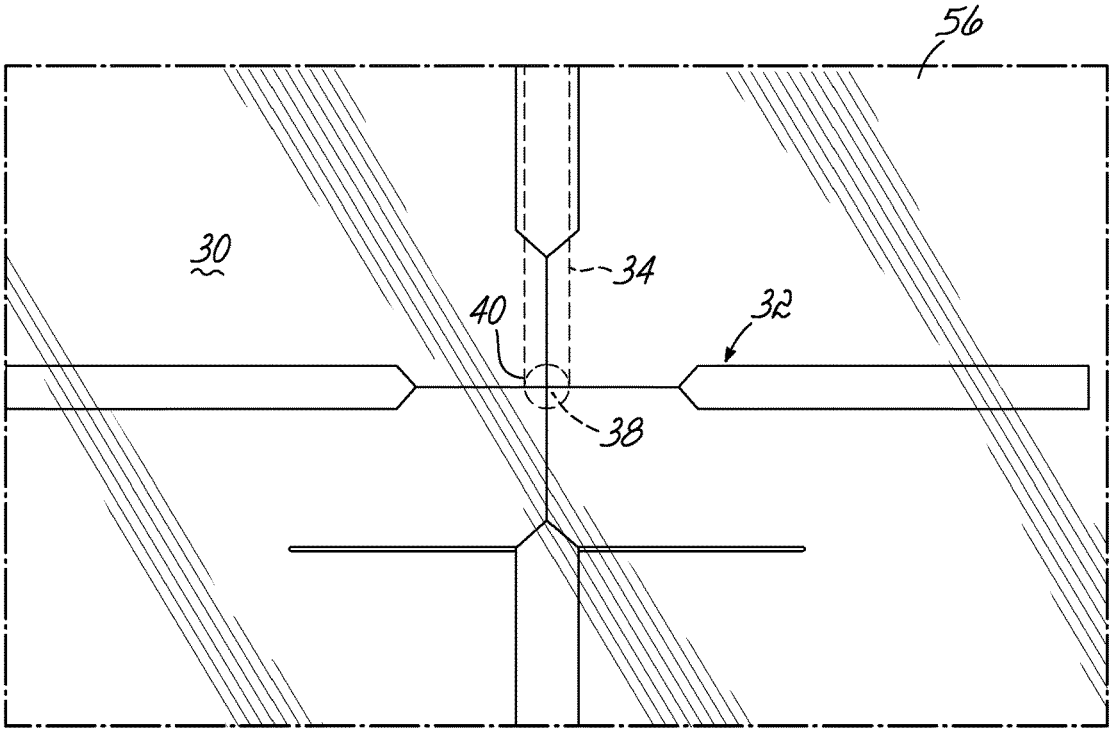
FIG. 10 is an enlarged detail rear elevation view thereof from the ocular side of the reticle disc.

The assembled disc/fiber unit 26, 34 may be further assembled into a mounting frame 42. As illustrated in FIG. 7, according to one embodiment, a proximal end portion 44 of the optical fiber 34 may extend through a radial notch or opening 46 in the frame 42. The opening 46 may then be filled with an opaque material 48, such as an epoxy resin, and then (after curing) the material 48 and fiber 34 ground smooth and polished so that the fiber 34 presents a light-receiving end 50. The illumination source can be, for example, a red (660 nm) LED. Alternatively, a laser diode could be used for more efficient and brighter illumination. As schematically illustrated in FIG. 8, a light source, such as an LED 52 may be positioned to supply light into the optical fiber 34. The LED 52 or other illumination source may be coupled to the fiber optic input end 50 with a focusing element (not shown), such as a ball lens or gradient index lenses, or it may be "butt coupled" without any focusing element at all, wherein the light source feeds directly into the flat end face 50 of the fiber 34. The assembly could also include polarization control for a laser diode based system to provide light intensity at eye-safe levels. Depending on the coupling method used (and its associated sensitivity to the positioning of the illumination source), the light source may become an integral part of the reticle and housing assembly. Alternatively, a proximal portion 44 of the fiber 34 may extend to a source of light (not shown) located elsewhere or further from the periphery of the disc 26 and/or frame 42.

Figure 11:
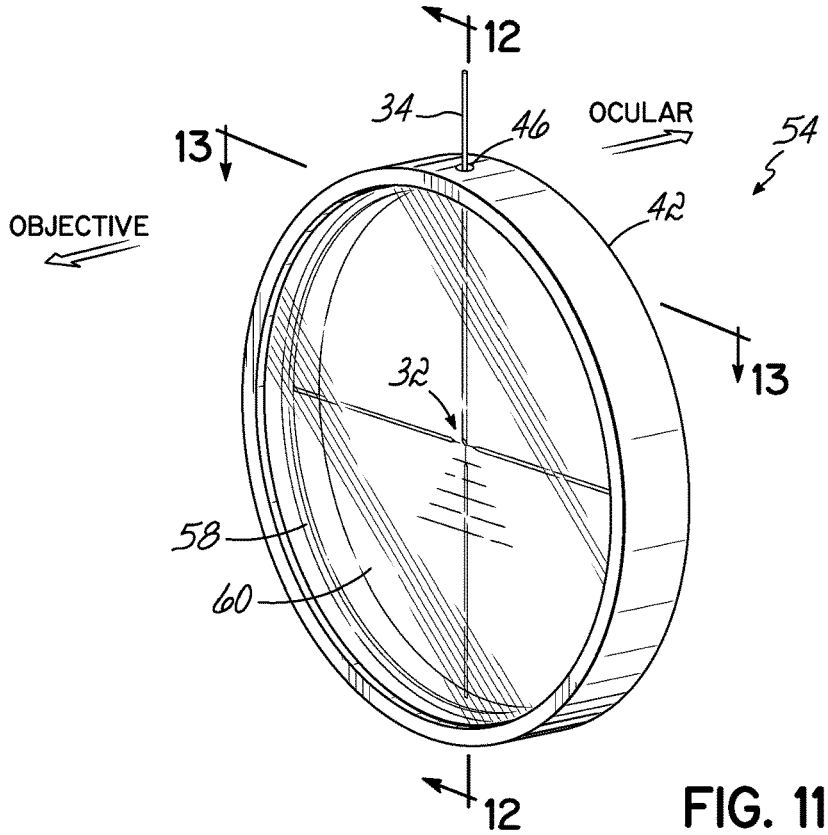
FIG. 11 is an assembled isometric view thereof.
Figure 12:
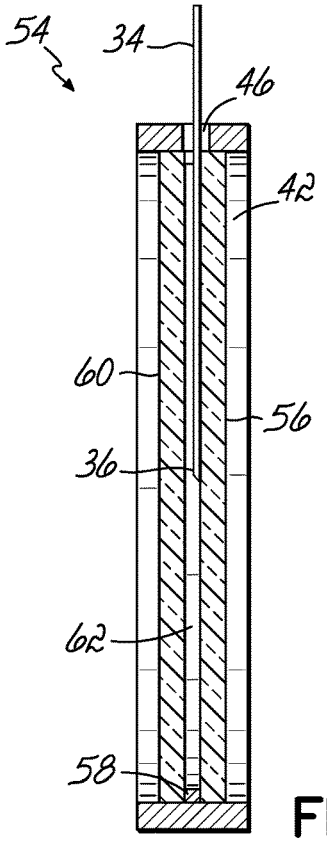
FIG. 12 is a side sectional view taken substantially along line 12-12 of FIG. 11.
Figure 13:
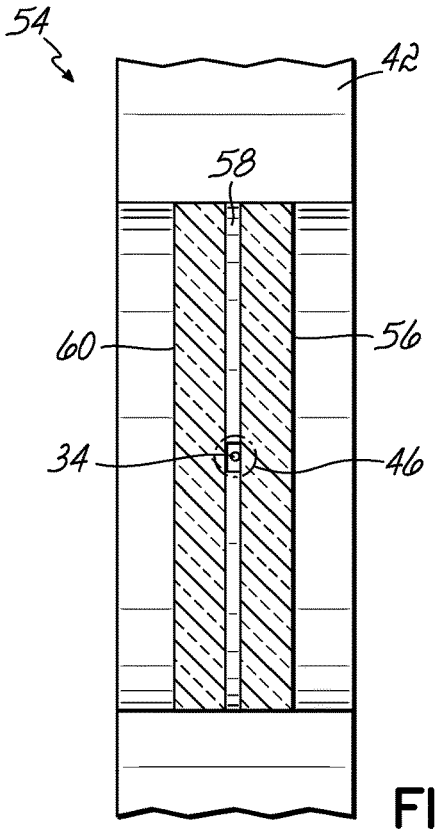
FIG. 13 is a top sectional view taken substantially along line 13-13 of FIG. 11.

Referring now to FIGS. 9-13, therein is shown a second embodiment reticle disc assembly 54, which can include a reticle disc 56 having a reticle pattern 32 on its objective face (as described above), an optical fiber 34, a spacer 58, a cover disc 60, and a frame 42. In this embodiment, the fiber 34 is illustrated extending from the top periphery of the assembly 54 along a top portion of a primary stadia line of the reticle pattern 32, although any desired orientation can be used. The fiber 34 may be secured to the reticle disc 56 as described above. As shown in FIGS. 11-13, the optical fiber 34 is "sandwiched" between the reticle disc 56 and cover disc 58. A spacer means 58 can be a unitary structure that extends substantially all the way around the periphery of the reticle disc 56 (as shown), or it may be a plurality of intermittent structures. Generally, the spacer 58 could be equal to or only very slightly greater in thickness than the thickness of the optical fiber 34. The space 62 regulated by the spacer 58 may be filled with an optically transparent cement or other adhesive. The fiber 34 may, for example, extend through a radial opening 46 in the frame 42 and be finished, if desired, as described above. Also as described above, the reticle pattern 32 may be illuminated by a light source separate from that providing light into the optical fiber 34, which provides a brightly lit aiming point.

Figure 15:
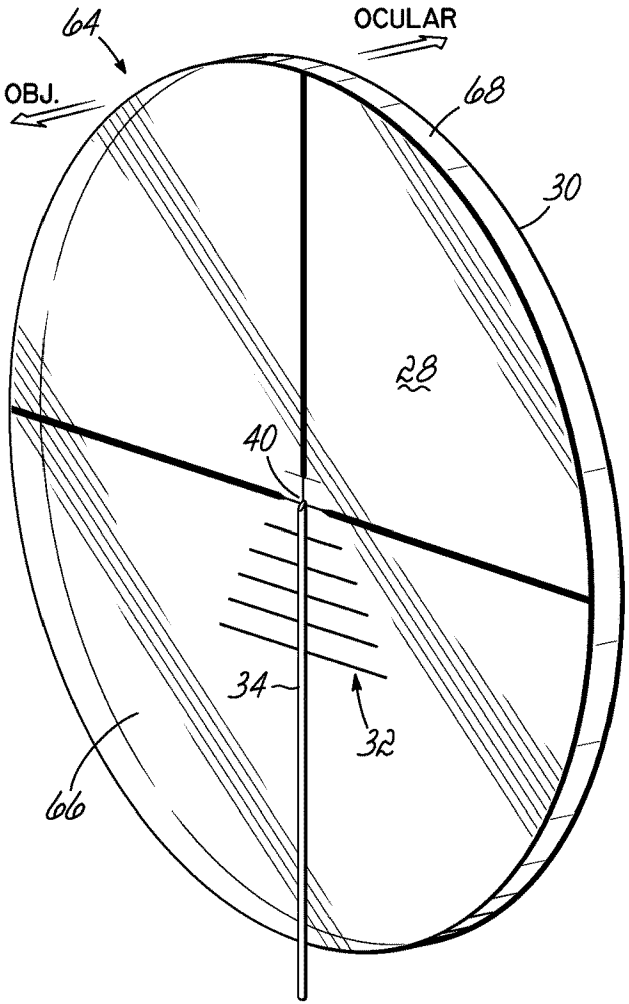
FIG. 15 is an assembled isometric view thereof.
Figure 14:
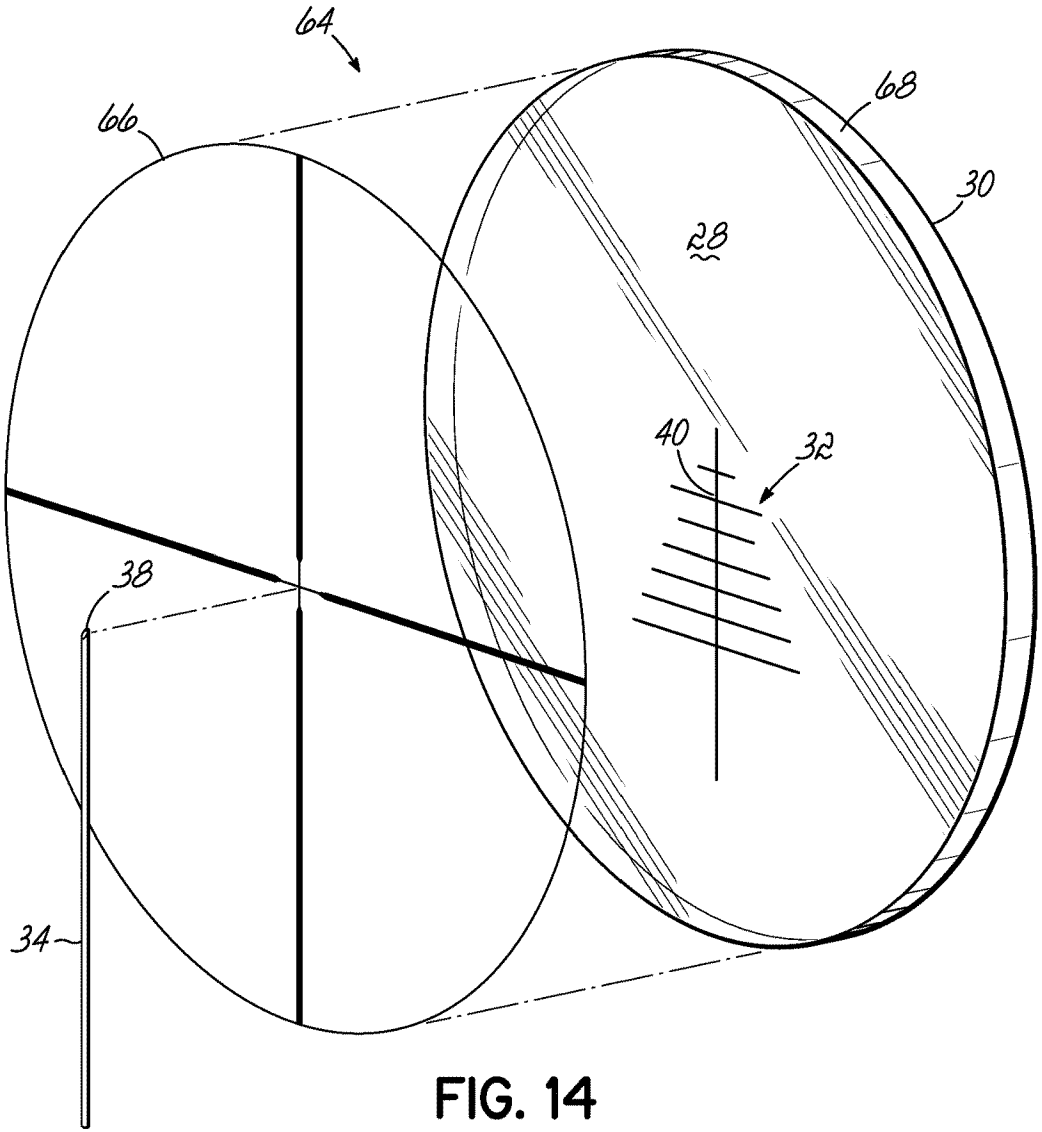
FIG. 14 is an exploded isometric view of a reticle disc and optical fiber before assembly according to a third embodiment of the invention.
Figure 17:
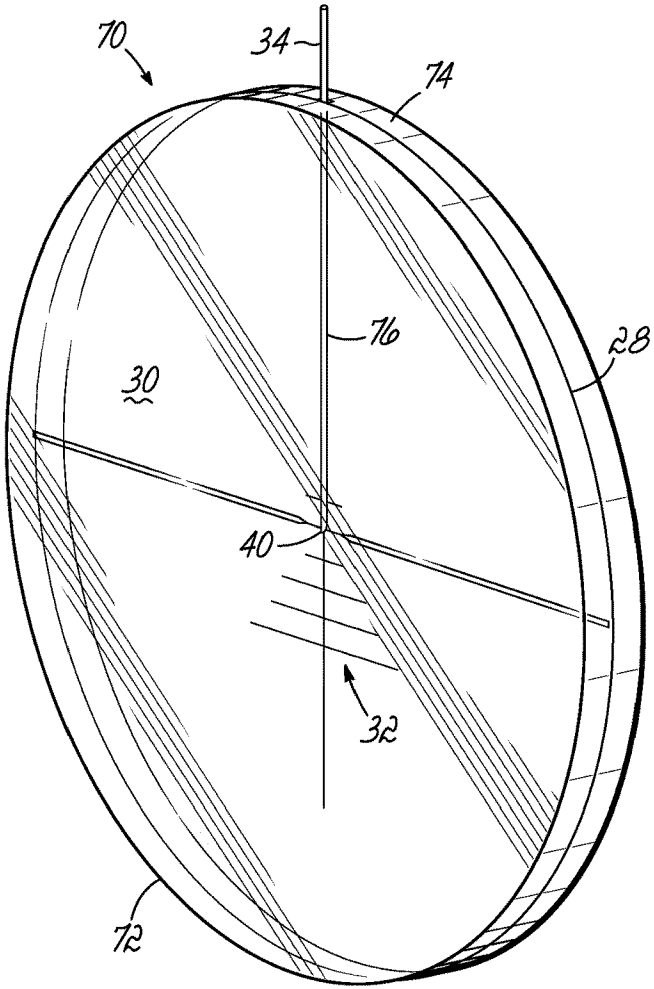
FIG. 17 is an assembled isometric view thereof.
Figure 16:
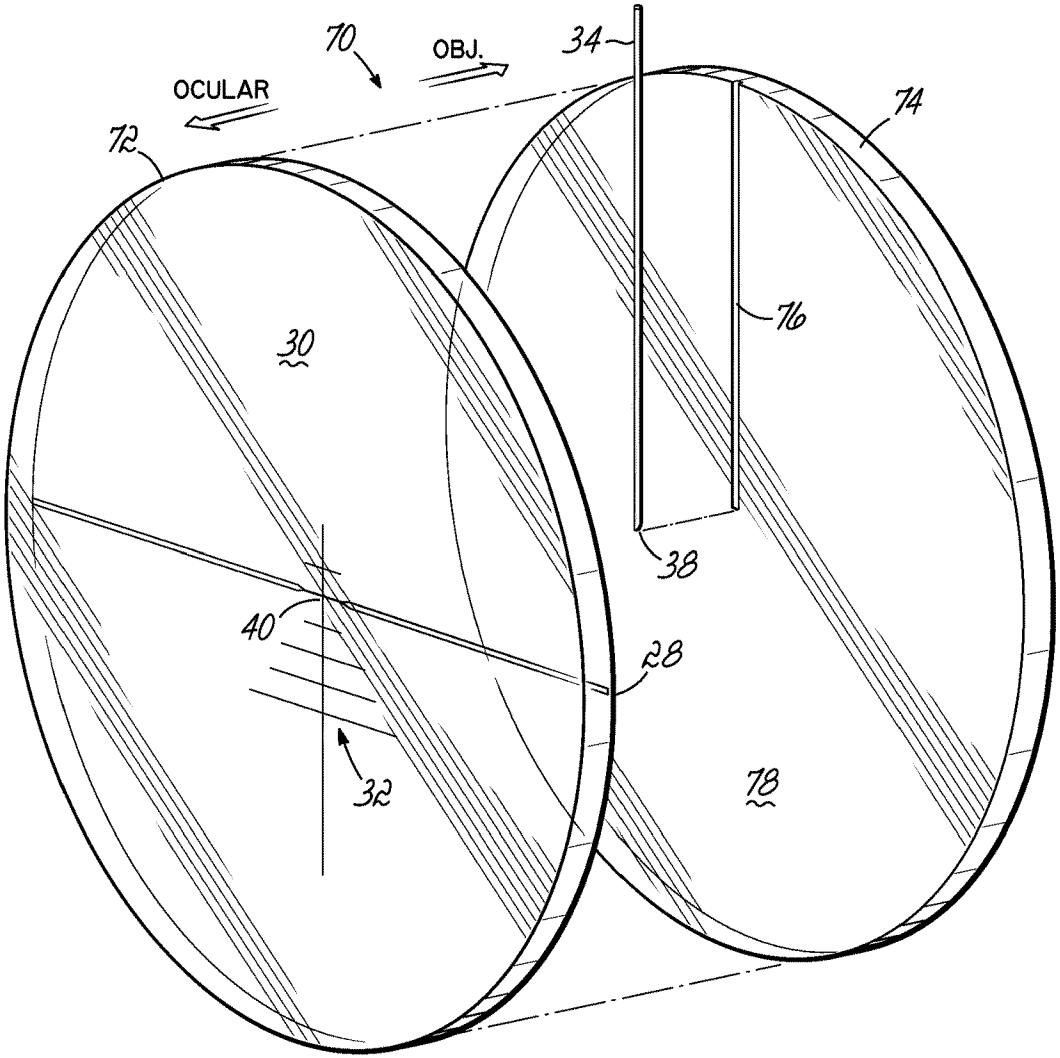
FIG. 16 is an exploded isometric view of a reticle disc and optical fiber before assembly according to a fourth embodiment of the invention.

A third embodiment reticle disc assembly 64 is shown in FIGS. 14 and 15. This embodiment includes a length of optical fiber 34, as described above, that is adhered to a wire or electroformed foil reticle 66, the combination of which is adhered to a reticle disc 68 having a reticle pattern 32 etched, engraved, or otherwise applied thereto. The optical fiber 34 can be adhered to one leg of the wire reticle 66 and the fiber 34 will be hidden along most of its length by the wire, as is known in the art. Different from known construction, however, the optical fiber 34 and wire reticle 66 can both be adhered directly to the reticle disc 68 so that all are aligned in the same focal plane 20, 22. When so assembled, the novel combination allows more complex reticle designs 32, including floating features, as well as the support of the wire reticle 66 for the optical fiber 34. By adhering them together, the reticle parts cannot become out of alignment. Additionally, also different from prior constructions, the fiber 34 can be situated on the objective side of the wire reticle 66, and both can be situated on the objective face 28 of the reticle disc 68. The wire reticle 66, along with the reticle pattern 32 on the objective face 28, can be viewed through the reticle disc 68. Likewise, the wire reticle 66 can be designed so as to not obscure the terminus 38 of the optical fiber 34, such as with a duplex pattern having very fine central crosshairs or with an open shape at the central aiming point 40, so the brightly illuminated aiming dot can also be viewed through the reticle disc 68. The reticle pattern 32 and/or wire reticle 66 may be illuminated separately from the aiming dot and/or each other, such as by flooding the edge or projecting light into an appropriately prepared pattern 32. A cover disc (not shown) can be used, but is not necessary.

Figure 18:
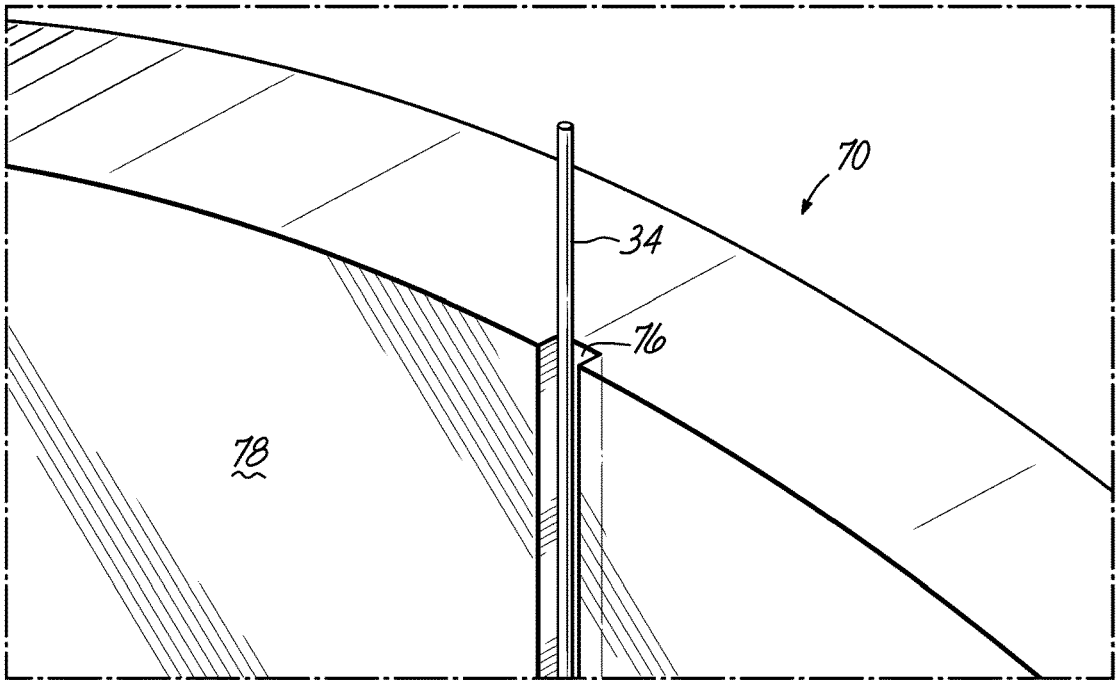
FIG. 18 is an enlarged detail isometric view showing the outer end of the optical fiber being assembled into a groove in the reticle disc.
Figure 19:
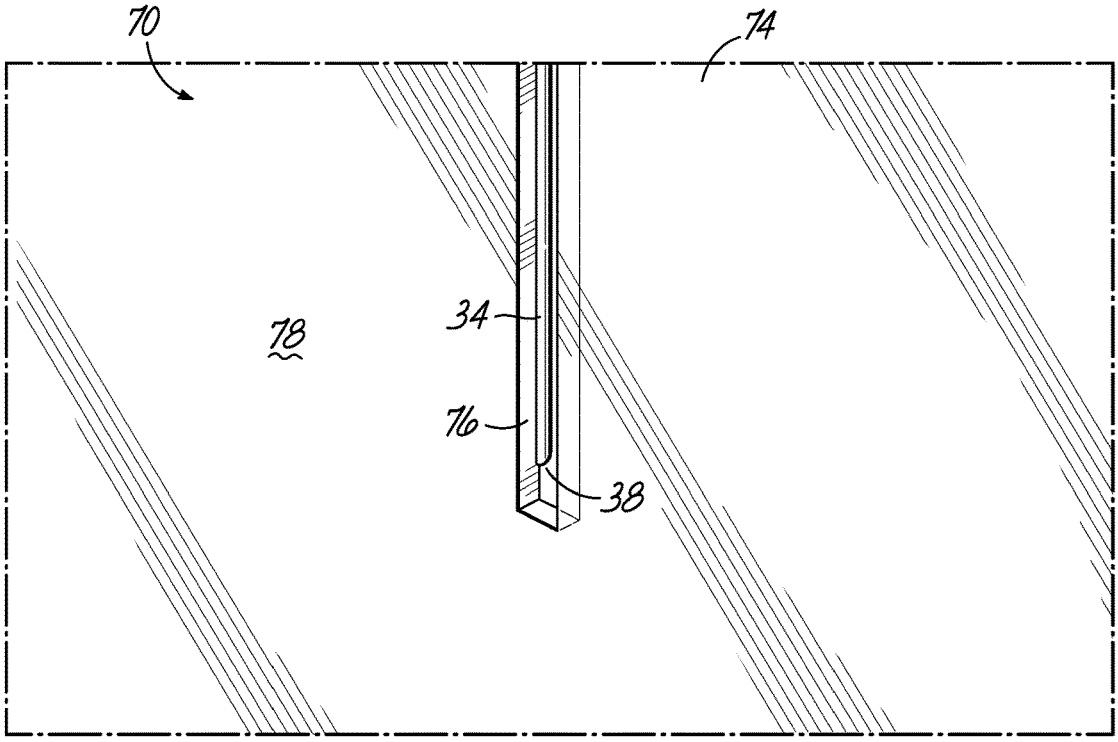
FIG. 19 is an enlarged detail isometric view showing the central end of the optical fiber being assembled into a groove in the reticle disc.
Figure 20:
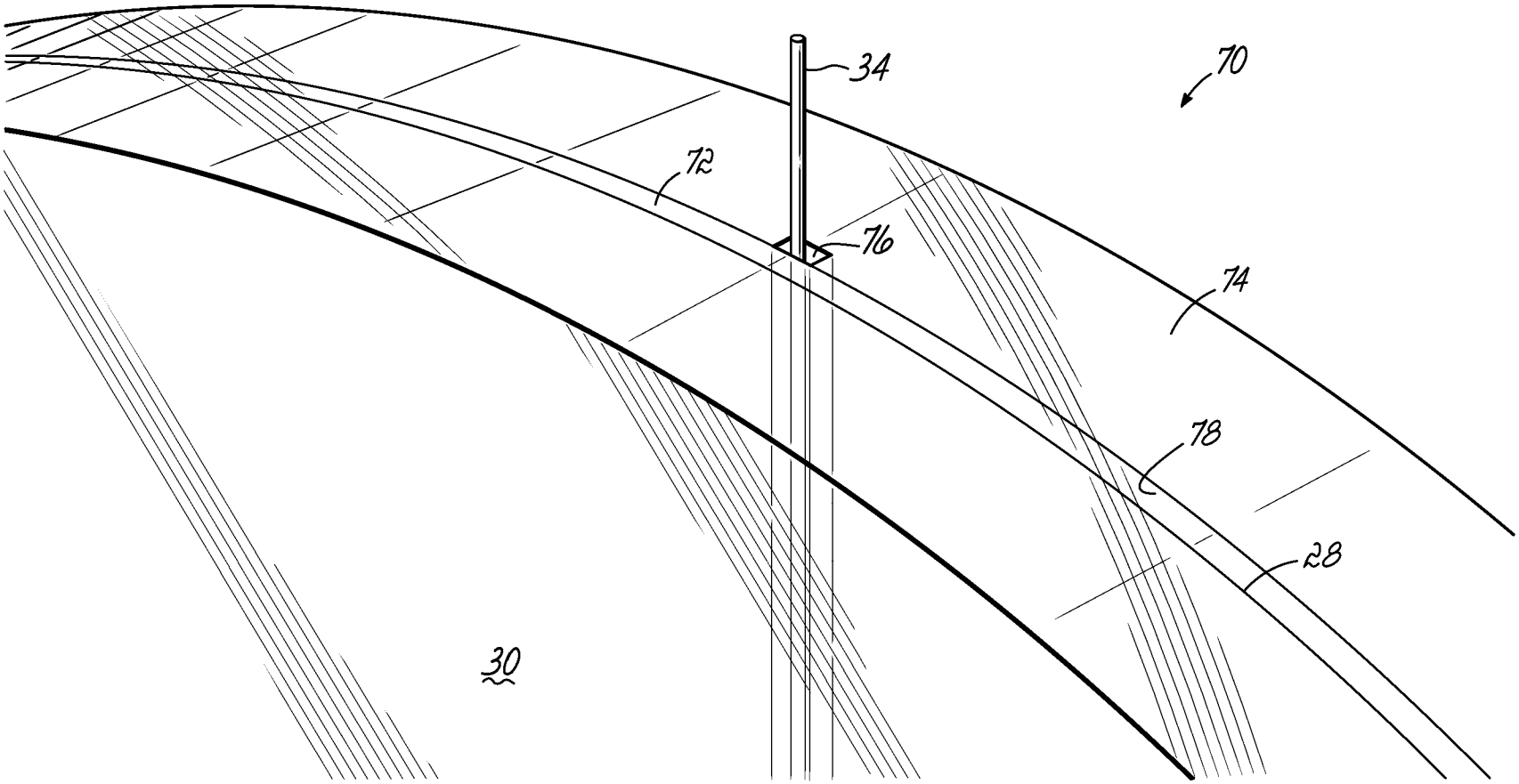
FIG. 20 is an enlarged detail isometric view showing the outer end of the optical fiber with a cover disc assembled thereon.

Referring now to FIGS. 16-20, therein is shown a fourth embodiment of a reticle disc assembly 70. In this embodiment, a reticle disc 72 is provided with a reticle pattern applied to its objective face 28, in the same manner as previously described. A corresponding cover disc 74 is provided and a channel 76 is formed in its ocular face 78 from a peripheral edge to a point corresponding to the central aiming point 40 of the reticle pattern 32. The channel 76 can be formed buy engraving, cutting, machining, etching, or any other suitable method. The channel 76 is sized to closely receive an optical fiber 34 (of the previously described form). The terminus 38 of the fiber 34 is oriented to project the brightly illuminated dot (as previously described) toward the ocular lens 14 in the optical path 16. The fiber 34 may be secured in place in the channel 76, such as with optical adhesive or cement, and then the reticle disc 72 and cover disc 74 "sandwiched" together with suitable optical adhesive. Index matching of reticle substrate materials, fiber, and bonding cement can be used to "hide" the fiber 34 in the assembly 70, whether or not aligned with a primary stadia of the reticle pattern 32, so that the user does not notice the presence of the fiber. Note that the spacing and sizes of relative structures in FIGS. 18-20 are not to scale and are particularly exaggerated for clarity of illustration.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An illuminated dot reticle for use in a rifle scope having an optical path defined through axially spaced-apart objective and ocular lenses, comprising:

a transparent reticle disc having a first surface facing the objective lens and a second surface facing the ocular lens;

a first reticle pattern applied to one of the reticle disc surfaces, the reticle pattern including a central aiming point;

an optical fiber having a proximal end portion and a distal end;

a light source configured to deliver light to the proximal end portion of the optical fiber; and the optical fiber being secured to the first surface of the reticle plate such that the distal end includes a beveled surface that reflects light substantially perpendicular to the optical fiber and is positioned to transmit light from the light source through the reticle disc and toward the ocular lens in the optical path, providing an illuminated dot at the central aiming point.

2. The reticle of claim 1, wherein the transparent reticle disc is glass.

3. The reticle of claim 1, wherein the reticle disc is positioned in a front focal plane of the rifle scope.

4. The reticle of claim 1, wherein the reticle disc is positioned in a rear focal plane of the rifle scope.

5. The reticle of claim 1, wherein the optical fiber is positioned at least partially on a primary stadia line of the reticle pattern.

6. The reticle of claim 1, wherein the reticle pattern is on the first surface and the reticle pattern and illuminated dot are viewed through the reticle disc.

7. The reticle of claim 1, wherein the reticle pattern is illuminated.

8. The reticle of claim 7, wherein the reticle pattern is separately illuminated by a second light source.

9. The reticle of claim 1, further comprising a cover disc positioned over the optical fiber.

10. The reticle of claim 9, further comprising a spacer means between the reticle disc and cover disk.

11. The reticle of claim 10, wherein the spacer means has a thickness of at least that of the optical fiber.

12. The reticle of claim 1, wherein the reticle disc further comprises a groove on one of the surfaces into which the optical fiber is secured.

13. An illuminated dot reticle for use in a rifle scope having an optical path defined through axially spaced-apart objective and ocular lenses, comprising:

a transparent reticle disc having a first surface facing the objective lens and a second surface facing the ocular lens;

a first reticle pattern applied to one of the reticle plate surfaces, the reticle pattern including a central aiming point;

a cover disc having a surface with a groove formed therein extending from a peripheral edge at least to a point corresponding with the central aiming point;

an optical fiber having a proximal end portion and a distal end;

a light source configured to deliver light to the proximal end portion of the optical fiber;

the optical fiber being positioned against the first surface of the reticle plate and secured into the groove such that the distal end includes a beveled surface that reflects light substantially perpendicular to the optical fiber and is positioned to transmit light from the light source through the reticle disc and toward the ocular lens in the optical path, providing an illuminated dot at the central aiming point.

14. The reticle of claim 13, wherein the cover disc is positioned with the grooved surface substantially against the surface of the reticle disc on which the reticle pattern is applied, such that the reticle pattern and illuminated dot are viewed through one of the reticle disc and cover disc.

15. A method of assembling a reticle disc for a rifle scope, comprising the steps of:

providing a transparent reticle disc having a periphery, a surface, and a first reticle pattern applied to the reticle disc surface, the reticle pattern including a central aiming point;

providing an optical fiber having a proximal end portion and a distal end;

positioning at least a portion of the optical fiber against the disc surface such that the distal end includes a beveled surface that reflects light perpendicular to the optical fiber and is positioned to transmit light from a light source through the reticle disc and toward the ocular lens substantially at the central aiming point and the proximal end portion extends beyond the periphery of the disc;

supplying a flowable, light-cure adhesive to the optical fiber adjacent the periphery such that the adhesive flows by capillary action along the optical fiber and disc surface toward the distal end; and exposing the adhesive to curing light when the flow of adhesive reaches a predetermined point in proximity to the distal end.

16. An illuminated optical sight reticle assembly comprising:

a transparent element having opposed major surfaces, a first major surface facing a target direction and a second major surface facing a viewer;

a reticle image formed on one of the major surfaces of the transparent element;

the reticle image defining a selected primary point; and an optical fiber adhered to the first major surface and having a first free end that includes a beveled surface that reflects light substantially perpendicular to the optical fiber is positioned proximate the selected primary point, and an opposed second free end away from the first free end and proximate to an illumination source such that light is transmitted from the illumination source to the first free end through the reticle disc and toward the ocular lens in the optical path, providing an illuminated primary point.

17. The illuminated optical sight reticle assembly of claim 16 including a fiber support structure having a periphery, and a span element extending from the periphery, the span element supporting the optical fiber.

18. The illuminated optical sight reticle assembly of claim 17 wherein the fiber support structure is a wire reticle.

19. The illuminated optical sight reticle assembly of claim 17 wherein the fiber support structure periphery is a ring, and wherein the span element includes a first elongated element extending diametrically across the ring.

20. The illuminated optical sight reticle assembly of claim 19 wherein the span element includes a second elongated element intersecting the first elongated element.

21. The illuminated optical sight reticle assembly of claim 16 wherein the reticle image is formed on the first major surface.

22. The illuminated optical sight reticle assembly of claim 16 wherein the reticle image includes a clear portion at the primary point such that the first free end of the optical fiber is visible through the clear portion.

23. The illuminated optical sight reticle assembly of claim 17 wherein the span element includes an elongated portion having a selected width and has an enlarged end portion at the periphery having a greater width.

* * * * *